US006959972B2

(12) United States Patent
Cude et al.

(10) Patent No.: US 6,959,972 B2
(45) Date of Patent: Nov. 1, 2005

(54) TRI-ACTION HINGE AND LATCHING MECHANISM FOR A DOOR PANEL

(75) Inventors: James Russell Cude, Lynn Haven, FL (US); Peter E. Simpson, Olive Branch, MS (US); Jeffrey C. Marks, Clarksville, TN (US)

(73) Assignee: American Standard International Inc., New York, NY (US)

( * ) Notice: Subject to any disclaimer, the term of this patent is extended or adjusted under 35 U.S.C. 154(b) by 30 days.

(21) Appl. No.: 10/298,642

(22) Filed: Nov. 15, 2002

(65) Prior Publication Data

US 2004/0093692 A1 May 20, 2004

(51) Int. Cl.[7] ..... A47B 95/00

(52) U.S. Cl. ..... 312/329; 49/257; 16/351; 16/362; 16/DIG. 42

(58) Field of Search ..... 16/350, 351, 362, 16/DIG. 42, 233; 312/326, 329, 236, 100, 138.1, 325; 49/208, 254, 257, 260

(56) References Cited

U.S. PATENT DOCUMENTS

| | | | | | |
|---|---|---|---|---|---|
| 1,508,013 | A | * | 9/1924 | De Waters | 16/351 |
| 1,605,296 | A | * | 11/1926 | Silvers | 16/375 |
| 1,678,512 | A | * | 7/1928 | Heinz | 16/233 |
| 1,908,831 | A | * | 5/1933 | Edward | 312/227 |
| 2,027,809 | A | | 1/1936 | Cornell, Jr. | |
| 2,185,035 | A | | 12/1939 | Melcher | |
| 2,939,297 | A | | 6/1960 | Karger et al. | |
| 3,479,104 | A | * | 11/1969 | Kobryner | 312/229 |
| 3,631,629 | A | * | 1/1972 | Bercheux | 49/256 |
| 4,548,330 | A | * | 10/1985 | Hewitt et al. | 220/210 |
| 4,660,872 | A | | 4/1987 | Carson et al. | |
| 4,747,505 | A | * | 5/1988 | Hansen | 220/4.28 |
| 4,843,839 | A | | 7/1989 | Davis | |
| RE35,392 | E | * | 12/1996 | Richardson et al. | 52/172 |
| 5,600,963 | A | | 2/1997 | Koo et al. | |
| 5,953,860 | A | * | 9/1999 | Morgan et al. | 49/257 |
| 6,092,386 | A | | 7/2000 | Lee | |
| 6,097,799 | A | * | 8/2000 | Wang | 379/143 |

* cited by examiner

*Primary Examiner*—Janet M. Wilkens
(74) *Attorney, Agent, or Firm*—William J. Beres; William O'Driscoll

(57) ABSTRACT

A hinge assembly allows an access panel to be pivotally coupled to a cabinet, even though the cabinet includes a top cover that overlaps an upper edge of the panel. To open the access panel, a latch is actuated to first release a lower edge of the panel. The hinge assembly then allows the lower edge to be pulled out from over a base rail of the cabinet. Once the lower edge is off of the base rail, the hinge assembly allows the panel to be lowered without obstruction from the base rail. Lowering the panel then moves the panel's upper edge out from underneath the overlapping top cover. From there, the hinge assembly allows the panel to be swung open. To close the access panel, the process is reversed.

41 Claims, 5 Drawing Sheets

FIG. 5
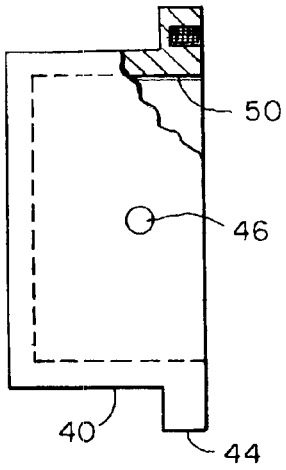
FIG. 6
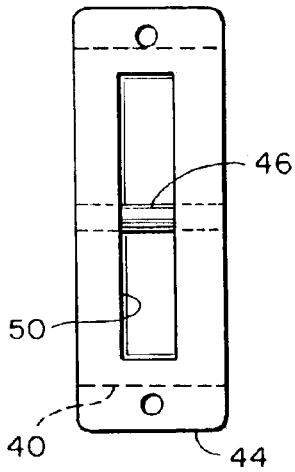
FIG. 8
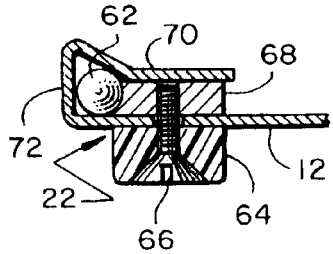
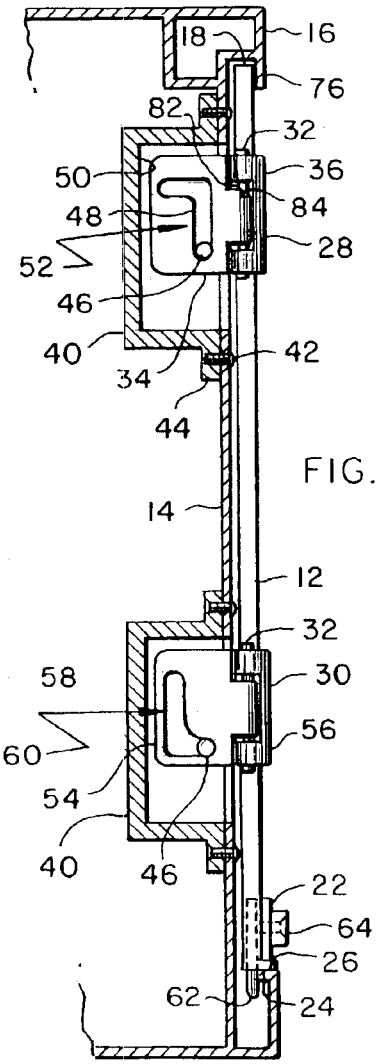
FIG. 7
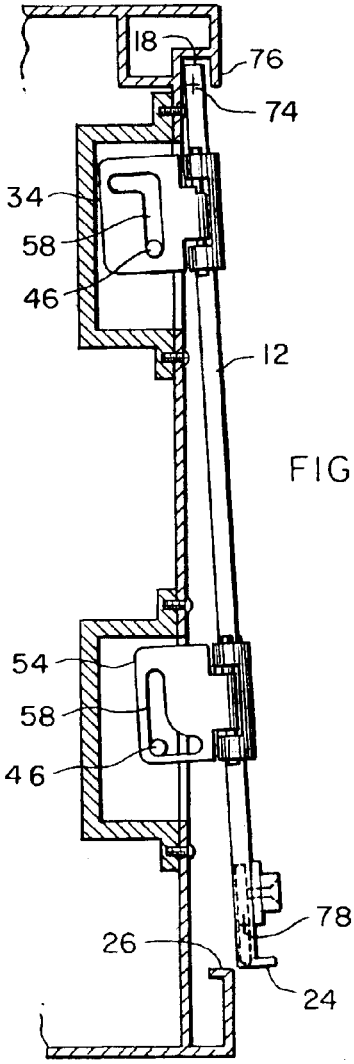
FIG 9

TRI-ACTION HINGE AND LATCHING MECHANISM FOR A DOOR PANEL

BACKGROUND OF THE INVENTION

1. Field of the Invention

The present invention pertains to a hinge and latching mechanism for an access panel, and more specifically to a mechanism that allows the panel to both pivot and translate.

2. Description of Related Art

When installed outdoors, heating, ventilating and air conditioning equipment (HVAC equipment) is often housed within a sheet metal enclosure to protect the equipment from weather. Such an enclosure typically comprises a cabinet with an access panel that can be readily opened or removed to provide access into the cabinet for inspecting or servicing the equipment. A gasket is usually installed round the perimeter of the access panel to provide a weather tight seal between the panel and the cabinet.

In some cases, an upper edge of an access panel may be tucked underneath a top cover to inhibit rain from leaking in past the top of the panel. Although effective, a top cover overlapping a hinged access panel may interfere with being able to swing the panel open. Consequently, such panels typically do not include hinges, but instead are slid in and out of position. To access the inside of the cabinet, the panel is slid out from underneath the top cover and completely removed from the cabinet. However, this can be difficult to do, as some panels can be rather cumbersome.

Hinged panels are often easier and more convenient to use than lift-out panels. But current designs do not allow a top cover to overlap a hinged panel. Thus, hinged panels usually must rely on a gasket to seal along the upper edge of the panel. However, it can be difficult to create an effective seal at the upper corners of the panel, i.e., where the gaskets along the panel's vertical edges meet the gasket that runs along the panel's horizontal upper edge. At these corners, the ends of the gaskets may overlap each other or never meet. If the gaskets overlap at the corners, the double thickness of gasket material may allow water to leak where there is only a single layer of gasket. If the gaskets do not meet at the corners, the resulting gap between adjacent gaskets may provide a leak path. Moreover, pliable gaskets tend to become stiff over time and eventually loose their ability to seal.

SUMMARY OF THE INVENTION

To allow the use of a hinged access panel with a cabinet whose top cover overlaps an upper edge of the panel, it is an object of the invention to mount the panel to the cabinet with a hinge assembly that provides some translation between the panel and the cabinet.

Another object of the invention is to attach a hinge to a bracket that enables relative translation and pivoting motion between the hinge and the bracket.

Another object is to provide a cam apparatus that couples a hinge to a bracket.

Another object is having the cam apparatus comprise a pin in sliding relationship with a slot.

A further object of the invention is to provide a hinged panel that can move out from underneath an overlapping top cover.

A still further object is to allow a hinged access panel to tilt between a substantially upright orientation and a leaning orientation.

Another object is to provide an articulated hinge with a feature that allows the hinge to maintain an access panel at a blocked open position.

Yet, another object of the invention is to incorporate a latch mechanism within a hem of an access panel.

Another object is mount a hinge plate within a cavity of a bracket that is attachable to a cabinet or an access panel.

These and other objects of the invention are provided by a hinge assembly for attaching an access panel to a cabinet, wherein the hinge assembly enables relative translation and pivoting motion between the access panel and the cabinet.

The present invention provides a hinge assembly adapted for pivotally coupling an access panel to a cabinet. The assembly comprises a first hinge plate; a second hinge plate pivotally coupled to the first hinge plate and adapted to be attached to one of the access panel and the cabinet; a bracket adapted to be attached to one of the access panel and the cabinet; and a cam apparatus that couples the first hinge plate to the bracket. The cam apparatus enables the first hinge plate to translate relative to the bracket.

The present invention also provides an enclosure. The enclosure comprises a cabinet; an access panel being selectively moveable to a closed position, an intermediate released position, and a swung open position; and a hinge assembly pivotally coupling the access panel to the cabinet. The access panel is pivotal about a first axis for moving between the closed position and the intermediate released position. The access panel is pivotal about a second axis for moving to and from the swung open position. The first axis traverses a vertical plane, the second axis traverses a horizontal plane, and the first and second axis lie at an angle to each other.

The present invention further provides a method of opening an access panel of a cabinet. The method comprises pivoting the access panel about a first axis that traverses a first vertical plane, thereby moving the access panel to an intermediate released position; lowering the access panel from the intermediate released position to a ready-to-open position; and after lowering the access panel to the ready-to-open position, moving the access panel to a swung open position by pivoting the access panel about a second axis that traverses a horizontal plane, wherein the first axis and axis are at an angle to each other.

The present invention additionally provides a method of opening an access panel. The method comprises the steps of: releasing a vertically planar access panel many latching constraints; slideably moving a lower end of the access panel so that the access panel is no longer vertically arranged; moving the access panel in a downward direction; moving an upper end of the access panel so that the access panel is again vertically arranged; and pivoting the access panel along a vertical end so that the access panel opens in manner akin to a door.

The present invention yet further provides a method of closing an access panel. The method comprises the steps of: pivoting the access panel along a vertical end so that the access panel opens in manner akin to a door; moving an upper end of the access panel so that the access panel is again vertically arranged; and moving the access panel in a downward direction; slideably moving a lower end of the access panel so that the access panel is no longer vertically arranged; releasing a vertically planar access panel many latching constraints.

The present invention still further provides an access panel arrangement. The arrangement comprises a substantially planar access panel; a first hinge plate arrangement engaged with an upper portion of the access panel; and a second hinged plate arrangement engaged with a lower portion of the access panel. The first hinge plate arrangement includes a first plate engaging the access panel, a second plate for engagement with a housing or the like, the second plate including a slot in the shape of a L rotated 180°, and a first pivot pin joint operably moveable connecting the first and second plates. The second hinge plate arrangement includes a third plate engaging the access panel, a fourth plate engaging the housing or the like, the fourth plate including a slot in the shape of a L, and a second pivot pin moveably engaging the third and fourth plates.

BRIEF DESCRIPTION OF THE DRAWINGS

FIG. 5 is a side view of a bracket with its corresponding hinge plate omitted for clarity.

FIG. 6 is an end view of the bracket in FIG. 5.

FIG. 7 is a cross-sectional view taken along line 7—7 of FIG. 1.

FIG. 8 is a cross-sectional view taken along line 8—8 of FIG. 1.

FIG. 9 is similar to FIG. 7, but showing the access panel in an intermediate released position.

DESCRIPTION OF THE PREFERRED EMBODIMENT

Figure 1:
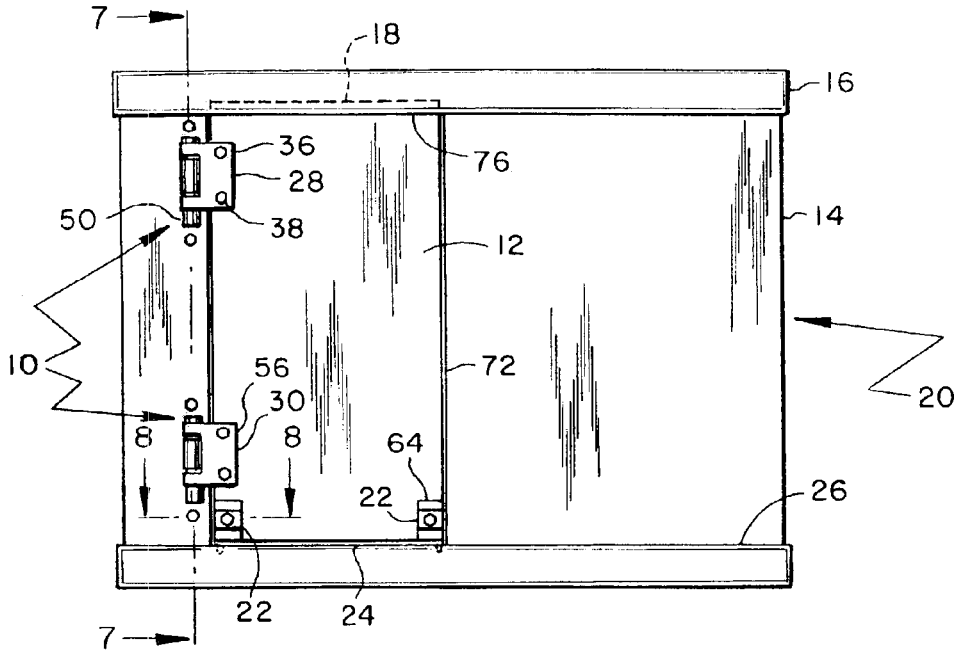
FIG. 1 is a front view of an enclosure with a hinge assembly and an access panel shown in a closed position, according to one embodiment of the invention.
Figure 2:
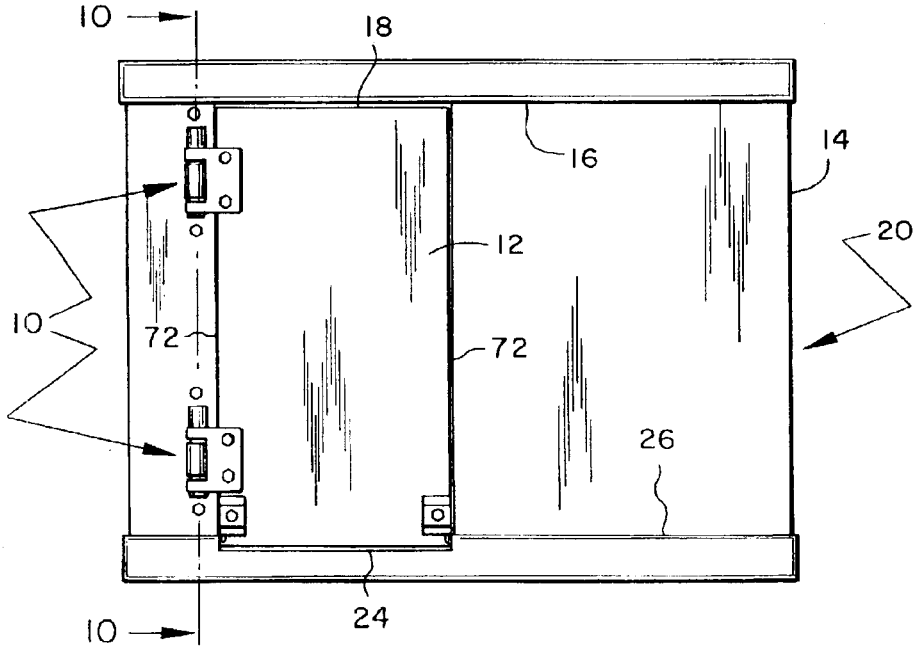
FIG. 2 is similar to FIG. 1, but with the access panel in a ready-to-open position.
Figure 3:
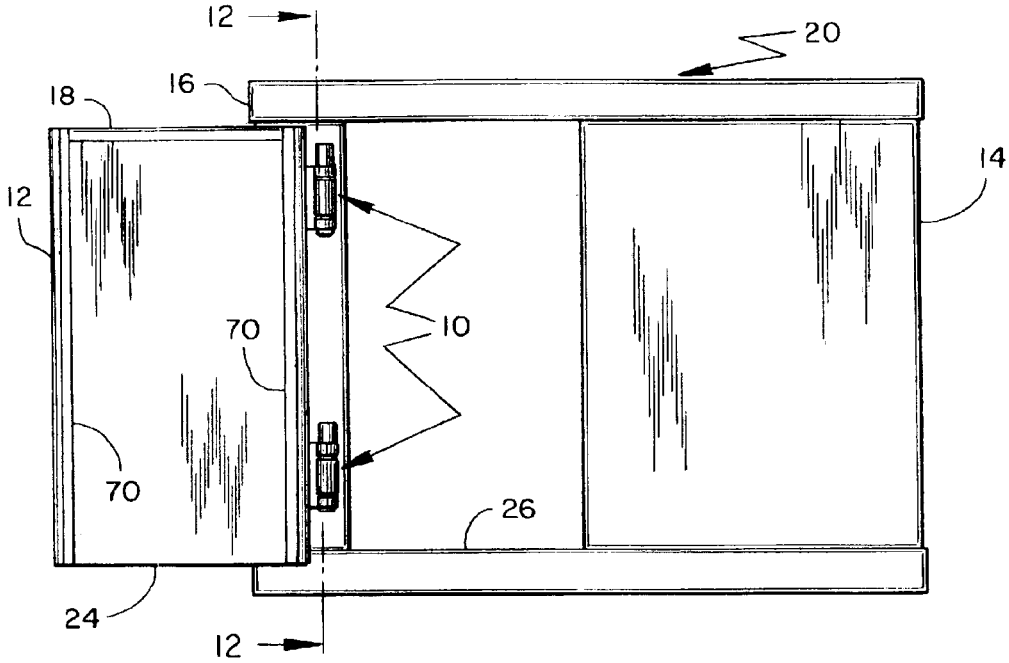
FIG. 3 is similar to FIG. 1, but with the access panel in a blocked open position.

A hinge assembly 10, shown in FIGS. 1–3, allows an access panel 12 to be pivotally coupled to a cabinet 14, even though the cabinet includes a top cover 16 that overlaps an upper edge 18 of panel 12. Cabinet 14 and access panel 12 comprise an enclosure 20 preferably but not necessarily used to house HVAC equipment.

To open access panel 12 from its closed position of FIG. 1, one or more latches 22 are actuated to first release a lower edge 24 of panel 14. Hinge assembly 10 then allows lower edge 24 to be pulled out from over a base rail 26 of cabinet 14. Once lower edge 24 is off of base rail 24, hinge assembly 10 allows panel 12 to be lowered without obstruction from base rail 26. Lowering panel 12 moves the panel's upper edge 18 out from underneath the overlapping top cover 16, as shown in FIG. 2. From there, hinge assembly 10 allows panel 12 to be swung open to the position shown in FIG. 3. To close the access panel, the process is reversed.

Figure 4:
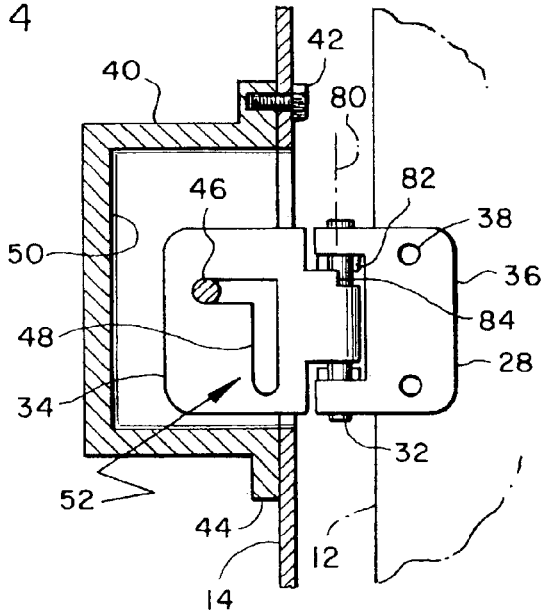
FIG. 4 is a cross-sectional view showing an upper hinge and the access panel in a swung open position with the panel being about halfway between its closed position and its blocked open position.

To achieve such articulated hinge operation, hinge assembly 10 includes an upper hinge 28 and a lower hinge 30. Referring to FIG. 4, upper hinge 28 includes a hinge pin 32 that pivotally connects a first upper hinge plate 34 to a second upper hinge plate 36. The second upper hinge plate 36 attaches to access panel 12 by way of screws 38 or some other fastener or fastening method. A bracket 40 couples the first upper hinge plate 34 to a stationary portion of cabinet 14. This can be done in various ways; however, in one embodiment of the invention, screws 42 attach a flange 44 of bracket 40 to cabinet 14. In addition, a pin 46 attached to bracket 40 engages a generally L-shaped slot 48 (i.e., one portion or leg of slot 48 is approximately perpendicular to another portion) in first upper hinge plate 34. Pin 46 in slot 48 keeps first upper hinge plate 34 generally inside a cavity 50 of bracket 40, yet allows hinge plate 34 to pivot and slide within cavity 50. Pin 46 and slot 48 comprise a cam apparatus 52, wherein pin 46 is one example of a cam element and slot 48 is one example of a cam surface.

Bracket 40 is schematically illustrated in FIGS. 5 and 6 to avoid cluttering the drawings with minor details that could interfere with being able to understand the bracket's main structure and function. In some embodiments of the invention, bracket 40 is a plastic injection with pin 46 being inserted during the molding process to become an integral component of bracket 40. Bracket 40 may include slightly tapered surfaces, various ribs, bracing, and other common features known to facilitate a plastic injection molding process.

Similar to upper hinge 28, lower hinge 30 also includes a hinge pin 46 that pivotally connects a first lower hinge plate 54 to a second lower hinge plate 56. The second lower hinge plate 56 attaches to access panel 12 by way of screws 38 or some other fastener or fastening method. Bracket 40 couples the first lower hinge plate 54 to a stationary portion of cabinet 14. Pin 46, which is fixed relative to bracket 40, engages a generally L-shaped slot 58 in first lower hinge plate 54. Pin 46 and slot 58 comprise another cam apparatus 60, wherein slot 58 is another example of a cam surface. However, slot 58 lies in a different orientation than does slot 48 for reasons that will be understood with a more detailed description of the access panel's operation.

To open access panel 12 from its closed position of FIGS. 1 and 7, latches 22 are slid upward to lift a pin 62 out of engagement with base rail 26. Referring further to FIG. 8, latch 22 includes a hand operated knob 64 that a screw 66 attaches to a bar 68 from which pin 62 is affixed. Screw 66 slides vertically along a slot in access panel 12, while bar 68 and pin 62 slide along a hem 70 formed along vertical edges 72 of panel 12. Moving latch 22 upward from its latched position of FIG. 7 to its unlatched position of FIG. 9 allows the panel's lower edge 24 to be pulled out from over base rail 26 to an intermediate open position, as shown in FIG. 9. The outward movement of lower edge 24 is accomplished by pivoting panel 12 about a substantially horizontal axis 74 (FIG. 9). However, it should be noted that axis 74 does not necessarily have to be substantially horizontal. Axis 74 preferably has a horizontal component, wherein axis 74 traverses (i.e., intersects or passes through) a vertical plane. In other words, axis 74 is something other than vertical. In some cases, panel 12 is provided with a conventional handle to make it easier to pull the panel's lower edge outward.

Figure 10:
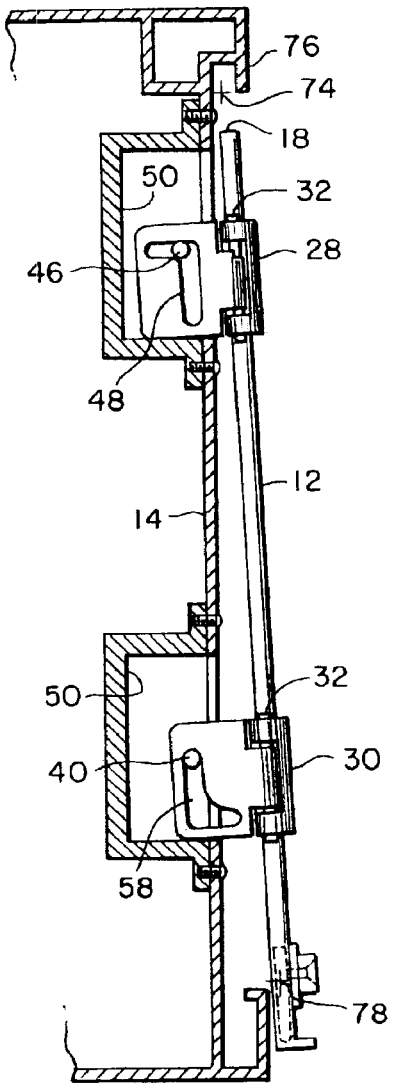
FIG. 10 is similar to FIG. 7, but showing the access panel in a ready-to-open position with the panel being in a leaning orientation.

Next, panel 12 is slid downward to lower the panel's upper edge 18 below a retaining lip 76 of top cover 16. At this point, panel 12 is at its ready-to-open position, as shown in FIG. 10. The downward translation of panel 12 is facilitated by relative sliding motion between pin 46 and slot 48 of upper hinge 28, relative sliding motion between pin 46 and slot 58 of lower hinge 30, and the vertical clearance of hinge plates 34 and 54 within their respective bracket cavities 50. The relative pin/slot sliding motion can be seen by comparing the pin to slot orientations of FIG. 9 to those of FIG. 10.

After panel 12 is moved to its ready-to-open position, panel 12 can be tilted, about another axis 78 below axis 74, from its leaning orientation of FIG. 10 to a substantially upright orientation of FIG. 11. Here, panel 12 is still at a ready-to-open position; however, hinge pins 32 of hinges 28 and 30 become aligned generally one above the other, due to relative sliding movement of pin 46 along the upper portion of slot 48. Panel 12 in its upright orientation provides clearance between cabinet 14 and the upper portion of panel 12, so panel 12 can be swung open without interfering with the cabinet. Moreover, the vertical alignment of the two hinge pins allows panel 12 to swing about a substantially vertical axis 80, whereby panel 12 avoids swinging under the impetus of its own weight. However, it should be noted that axis 80 does not necessarily have to be substantially vertical. Axis 80 preferably has a vertical component, wherein axis 80 traverses (i.e., intersects or passes through) a horizontal plane. In other words, axis 80 is something other than horizontal.

Figure 11:
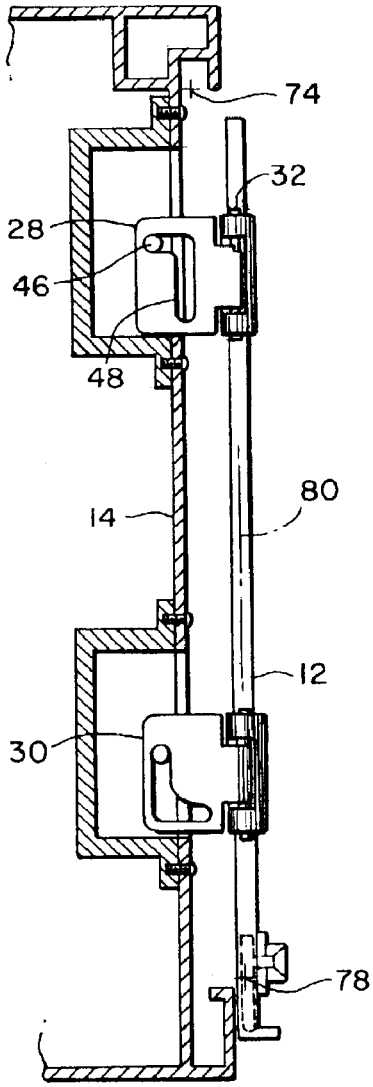
FIG. 11 is similar to FIG. 7, but showing the access panel in another ready-to-open position with the panel being in a substantially upright orientation.

From the ready-to-open positions of FIG. 10 or 11, panel 12 can be swung about axis 80 across a range of swung open positions, such as the swung open position of FIG. 4.

Figure 12:
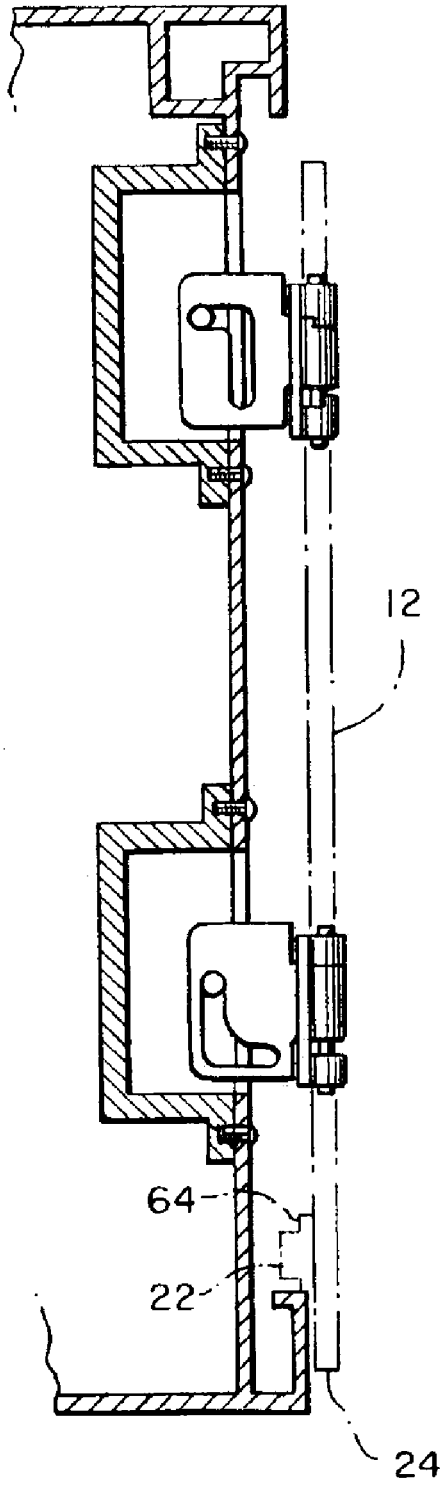
FIG. 12 is a cross-sectional view taken along line 12—12 of FIG. 3.

Access panel 12 can also be swung fully open where, in some embodiments, hinges 28 and 30 allow panel 12 to descend from a swung open position to a blocked open position, as shown in FIGS. 3 and 12. In the blocked open position, hinge assembly 10 inhibits panel 12 from inadvertently swinging shut without first lifting panel 12 out from its lowered blocked open position to a swung open position. This can be accomplished by allowing some vertical sliding movement between hinge plates 34 and 36 and between hinge plates 54 and 56. In addition, at least one of the hinges, such as upper hinge 28 can be provided with a tab 82 fixed to plate 36 and a groove 84 fixed to plate 34 that engagingly mate when panel 12 is rotated to a certain fully open position. When mated, tab 82 engages groove 84 to inhibit relative rotation of hinge plates 34 and 36.

As mentioned earlier, access panel 12 is closed by reversing the operational sequence just described.

Although the invention is described with reference to a preferred embodiment, it should be appreciated by those skilled in the art that other variations are well within the scope of the invention. For example, latch 22 can be replaced by a locking mechanism that requires a tool for opening panel 12. Also, tab 82 and/or groove 84 of hinge 28 can be omitted. If omitted, panel 4 can be blocked or braced open by some other means, or panel 4 may simply not include a blocked open position. Therefore, the scope of the invention is to be determined by reference to the claims, which follow.

We claim:

1. An enclosure, comprising:

a cabinet;

an access panel being selectively moveable to a closed position, an intermediate released position, and a swung open position; and a hinge assembly pivotally coupling the access panel to the cabinet such that the access panel is pivotal about a first axis for moving between the closed position and the intermediate released position, and the access panel is pivotal about a second axis for moving to and from the swung open position, wherein the first axis traverses a vertical plane, the second axis traverses a horizontal plane, and the first and second axis lie at an angle to each other;

wherein the access panel is moveable to a blocked open position that is lower than the swung open position, wherein the hinge assembly helps prevent the access panel at the blocked open position from freely moving to the intermediate released position and the closed position until the access panel first rises from the blocked position to the swung open position.

2. The enclosure of claim 1, further comprising a top cover atop the cabinet, wherein the access panel tucks underneath the top cover upon moving from a ready-to-open position to the intermediate released position.

3. The enclosure of claim 1, wherein the hinge assembly includes a lower hinge comprising a first lower hinge plate coupled to the cabinet and pivotally coupled to a second lower hinge plate that is coupled to the access panel, and wherein the lower hinge is able to translate relative to one of the cabinet and the access panel.

4. The enclosure of claim 3, wherein the lower hinge is able to translate vertically relative to one of the cabinet and the access panel.

5. The enclosure of claim 3, wherein the lower hinge is able to translate horizontally relative to one of the cabinet and the access panel.

6. The enclosure of claim 3, wherein the lower hinge is able to translate vertically and horizontally relative to one of the cabinet and the access panel.

7. The enclosure of claim 3, further comprising: a bracket that couples the lower hinge to one of the cabinet and the access panel; and a cam apparatus that couples the lower hinge to the bracket, wherein the cam apparatus includes a cam element whose relative movement along a cam surface enables the lower hinge to translate relative to one of the cabinet and the access panel.

8. The enclosure of claim 7, wherein the cam surface is disposed on the lower hinge.

9. The enclosure of claim 7, wherein the cam element is fixed relative to the bracket.

10. The enclosure of claim 7, wherein the cam element is a pin and the cam surface is a slot defined by one of the bracket and the lower hinge.

11. The enclosure of claim 10, wherein the slot runs horizontally and vertically.

12. The enclosure of claim 7, wherein the cam apparatus and one of the first lower hinge plate and the second lower hinge plate are disposed within a cavity defined by the bracket.

13. The enclosure of claim 3, wherein the hinge assembly includes an upper hinge above the lower hinge, wherein the upper hinge comprises a first upper hinge plate coupled to the cabinet and pivotally coupled to a second upper hinge plate that is coupled to the access panel, and wherein the upper hinge is able to translate relative to one of the cabinet and the access panel.

14. The enclosure of claim 13, wherein the upper hinge is able to translate vertically relative to one of the cabinet and the access panel.

15. The enclosure of claim 13, wherein the upper hinge is able to translate horizontally relative to one of the cabinet and the access panel.

16. The enclosure of claim 13, wherein the upper hinge is able to translate vertically and horizontally relative to one of the cabinet and the access panel.

17. The enclosure of claim 13, further comprising: a bracket that couples the upper hinge to one of the cabinet and the access panel; and a cam apparatus that couples the upper hinge to the bracket, wherein the cam apparatus includes a cam element whose relative movement along a cam surface enables the upper hinge to translate relative to one of the cabinet and the access panel.

18. The enclosure of claim 17, wherein the cam surface is disposed on the upper hinge.

19. The enclosure of claim 17, wherein the cam element is fixed relative to the bracket.

20. The enclosure of claim 17, wherein the cam element is a pin and the cam surface is a slot defined by one of the bracket and the upper hinge.

21. The enclosure of claim 20, wherein the slot runs horizontally and vertically.

22. The enclosure of claim 17, wherein the cam apparatus and one of the first upper hinge plate and the second upper hinge plate bracket are disposed within a cavity defined by the bracket.

23. The enclosure of claim 13, wherein the first upper hinge plate is able to translate relative to the second upper hinge plate to enable the access panel to move to the blocked open position that is lower than the swung open position, wherein the hinge assembly helps prevent the access panel at the blocked open position from freely moving to the intermediate released position and the closed position until the access panel first rises from the blocked position to the swung open position.

24. The enclosure of claim 3, wherein the first lower hinge plate is able to translate relative to the second lower hinge plate to enable the access panel to move to the blocked open position that is lower than the swung open position, wherein the hinge assembly helps prevent the access panel at the blocked open position from freely moving to the intermediate released position and the closed position until the access panel first rises from the blocked position to the swung open position.

25. An enclosure, comprising:

a cabinet;

an access panel being selectively moveable to a closed position, an intermediate released position, and a swung open position; and a hinge assembly pivotally coupling the access panel to the cabinet such that the access panel is pivotal about a first axis for moving between the closed position and the intermediate released position, and the access panel is pivotal about a second axis for moving to and from the swung open position, wherein the first axis traverses a vertical plane, the second axis traverses a horizontal plane, and the first and second axis lie at an angle to each other;

wherein the access panel is moveable from the intermediate released position to a ready-to-open position that is lower than the intermediate released position, and the access panel is moveable between the ready-to-open position and the swung open position.

26. The enclosure of claim 25, wherein the access panel is translatable between the intermediate released position and the ready-to-open position.

27. The enclosure of claim 25, wherein the access panel pivots about the second axis upon moving between the ready-to-open position and the swung open position.

28. The enclosure of claim 25, wherein the panel in the ready-to-open position is able to tilt between a leaning orientation and a substantially upright orientation.

29. An enclosure, comprising:

a cabinet;

an access panel being selectively moveable to a closed position, an intermediate released position, and a swung open position;

a hinge assembly pivotally coupling the access panel to the cabinet such that the access panel is pivotal about a first axis for moving between the closed position and the intermediate released position, and the access panel is pivotal about a second axis for moving to and from the swung open position, wherein the first axis traverses a vertical plane, the second axis traverses a horizontal plane, and the first and second axis lie at an angle to each other;

a sheet metal hem disposed along a perimeter of the access panel; and a latch captured within the hem for sliding motion between a latched position and an unlatched position, wherein the latch engages the cabinet when the access panel is in the closed position and the latch is in the latched position, and the latch disengages the cabinet when the latch is in the unlatched position.

30. An enclosure, comprising:

a cabinet;

an access panel being selectively moveable to a closed position, an intermediate released position, and a swung open position; and a hinge assembly pivotally coupling the access panel to the cabinet such that the access panel is pivotal about a first axis for moving between the closed position and the intermediate released position, and the access panel is pivotal about a second axis for moving to and from the swung open position, wherein the first axis traverses a vertical plane, the second axis traverses a horizontal plane, and the first and second axis lie at an angle to each other;

wherein the panel in the swung open position is able to tilt between a leaning orientation and a substantially upright orientation.

31. A method of opening an access panel of a cabinet, comprising:

pivoting the access panel about a first axis that traverses a first vertical plane, thereby moving the access panel to an intermediate released position;

lowering the access panel from the intermediate released position to a ready-to-open position; and after lowering the access panel to the ready-to-open position, moving the access panel to a swung open position by pivoting the access panel about a second axis that traverses a horizontal plane, wherein the first axis and the second axis are at an angle to each other.

32. The method of claim 31, further comprising: pivoting the access panel about a third axis that traverses a second vertical plane to tilt the access panel between a leaning orientation and a substantially upright orientation, wherein the third axis is lower than the first axis.

33. The method of claim 32, wherein the step of pivoting the access panel about the third axis returns the access panel to the substantially upright orientation.

34. The method of claim 31, further comprising: after pivoting the access panel about the second axis, lowering the access panel further to a blocked open position.

35. The method of claim 31, wherein the step of lowering the access panel, the access panel is lowered away from a top cover of the cabinet.

36. The method of claim 31, wherein the step of pivoting the access panel about the second axis, the access panel is swung out from underneath a top cover.

37. The method of claim 31, wherein the access panel is in a substantially upright orientation before being pivoted about the first axis.

38. The method of claim 31, wherein the step of pivoting the access panel about the first axis places the access panel in a leaning orientation.

39. A method of opening an access panel comprising the steps of:

releasing a vertically planar access panel from any latching constraints;

slideably moving a lower end of the access panel so that the access panel is no longer vertically arranged;

moving the access panel in a downward direction;

moving an upper end of the access panel so that the access panel is again vertically arranged; and pivoting the access panel along a vertical end so that the access panel opens in manner akin to a door.

40. A method of closing an access panel comprising the steps of:

pivoting the access panel along a vertical end so that the access panel closes in manner akin to a door;

moving an upper end of the access panel so that the access panel is no longer vertically arranged;

moving the access panel in an upward direction;

slideably moving a lower end of the access panel so that the access panel is again vertically arranged; and engaging the vertically planar access panel with at least one latching constraint.

41. An access panel arrangement comprising:

a substantially planar access panel;

a first hinge plate arrangement engaged with an upper portion of the access panel; and a second hinged plate arrangement engaged with a lower portion of the access panel;

wherein the first hinge plate arrangement includes a first plate engaging the access panel, a second plate for engagement with a housing, the second plate including a slot in the shape of a L rotated 180°, and a first pivot pin joint operably moveable connecting the first and second plates; and wherein the second hinge plate arrangement includes a third plate engaging the access panel, a fourth plate engaging the housing or the like, the fourth plate including a slot in the shape of a L, and a second pivot pin moveably engaging the third and fourth plates.

* * * * *